US005549536A

United States Patent [19]

Clark

[11] Patent Number: 5,549,536

[45] Date of Patent: Aug. 27, 1996

[54] ROTATING PLATFORM APPARATUS

[76] Inventor: Dexter M. Clark, 2188 SE. Spruce St., Hillsboro, Oreg. 97123

[21] Appl. No.: 511,191

[22] Filed: Aug. 4, 1995

[51] Int. Cl.[6] ..... A63B 23/00

[52] U.S. Cl. ..... 482/146; 472/40

[58] Field of Search ..... 482/146, 23, 33, 482/95, 147, 148, 79; 472/1, 14, 18, 28, 35, 40

[56] References Cited

U.S. PATENT DOCUMENTS

| | | | |
|---|---|---|---|
| 1,565,484 | 12/1925 | McWhirter | 482/146 |
| 2,785,896 | 3/1957 | Ellis | 472/40 |
| 3,088,733 | 5/1963 | Ayres | 482/146 |
| 4,193,592 | 3/1980 | Bishop | 482/146 |
| 4,290,601 | 9/1981 | Mittelstadt | 482/146 |
| 4,673,180 | 6/1987 | Rice | 482/147 |

*Primary Examiner*—Stephen R. Crow
*Attorney, Agent, or Firm*—Rodger H. Flagg

[57] ABSTRACT

Applicant's invention discloses an inclined platform which rotates freely upon a base having an annular ring with at least three legs extending between the annular ring and an inclined collet. The inclined collet has an upper tapered bearing race and a lower bushing sized to rotatably receive a shaft mounted perpendicular to the underside of the inclined platform. The inclined platform is preferably covered with a pliable material with padding extending between the pliable material and the top side of the inclined platform. Flexible handles extend from opposing sides of the inclined platform to aid in supporting the user thereon. The user shifts their body weight to rotate the inclined platform, thus spinning the user about the base.

20 Claims, 2 Drawing Sheets

ROTATING PLATFORM APPARATUS

BACKGROUND OF THE INVENTION

FIELD OF THE INVENTION

This invention relates to an improved rotating platform apparatus, which is useful for recreation and exercise. The prior art discloses a variety of riding, rocking and turning toys, wobble plates, and swivel platforms, which are expensive to manufacture, have limited utility, or provide safety hazards. Many of these prior art devices have not reached the market place for the reasons noted above.

U.S. Pat. No. 3,088,733 issuing to R. Ayers on May 7, 1963 discloses a riding toy having an inclined platform supported on an obtusely angulated rod secured to the base. The rotation of the inclined platform is limited by the friction of the angulated rod as it rotates within a sleeve without the aid of bearings. The inclined platform is smaller than the base, and both the inclined platform and the base are supported by radially extending angle iron secured to the sleeve.

U.S. Pat. No. 4,290,601 issuing to R. Mittelstadt on Sep. 22, 1981 discloses a wobble plate having a peripheral roller support comprising rollers which contact the underside of treadle board 10 in proximity to the outer periphery of the treadle board. The user may accidentally grab the outer periphery of the treadle board during rotation while attempting to maintain balance, which poses a safety hazard by getting one's fingers between the rollers and the underside of the wobble board.

U.S. Pat. No. 4,193,592 issuing to R. Bishow on Mar. 18, 1908 discloses a rocking, turning toy for use in a sitting, standing or kneeling position. The base has an enlarged protuberance with a flat bottom. A caster assembly is located between the top surface of the lower member and the lower surface of the top member. A shaft extends from the lower surface. The device rotates about the shaft, and rocks upon the enlarged protuberance.

The following patents are representative of other rotating platforms found in this art. They are U.S. Pat. Nos. 5,368,536; 5,279,533; 4,953,858; 4,687,198; 4,605,224; 3,593,994 and 1,565,484.

SUMMARY OF THE INVENTION

Applicant's invention discloses an inclined platform which rotates freely upon a base having an annular ring with at least three legs extending between the annular ring and an inclined collet. The inclined collet has an upper tapered bearing race and a lower bushing sized to rotatably receive a shaft mounted perpendicular to the underside of the inclined platform. The inclined platform is preferably covered with a pliable material with padding extending between the pliable material and the top side of the inclined platform. Flexible handles extend from opposing sides of the inclined platform to aid in supporting the user thereon. The user shifts their body weight to rotate the inclined platform, thus spinning the user about the base.

The above mentioned and other features and objects of the invention, and the manner of obtaining them will be best understood by reference to the following description of an embodiment of the invention, when considered in conjunction with the accompanying drawings:

BEST MODE FOR CARRYING OUT THE INVENTION

Figure 1:
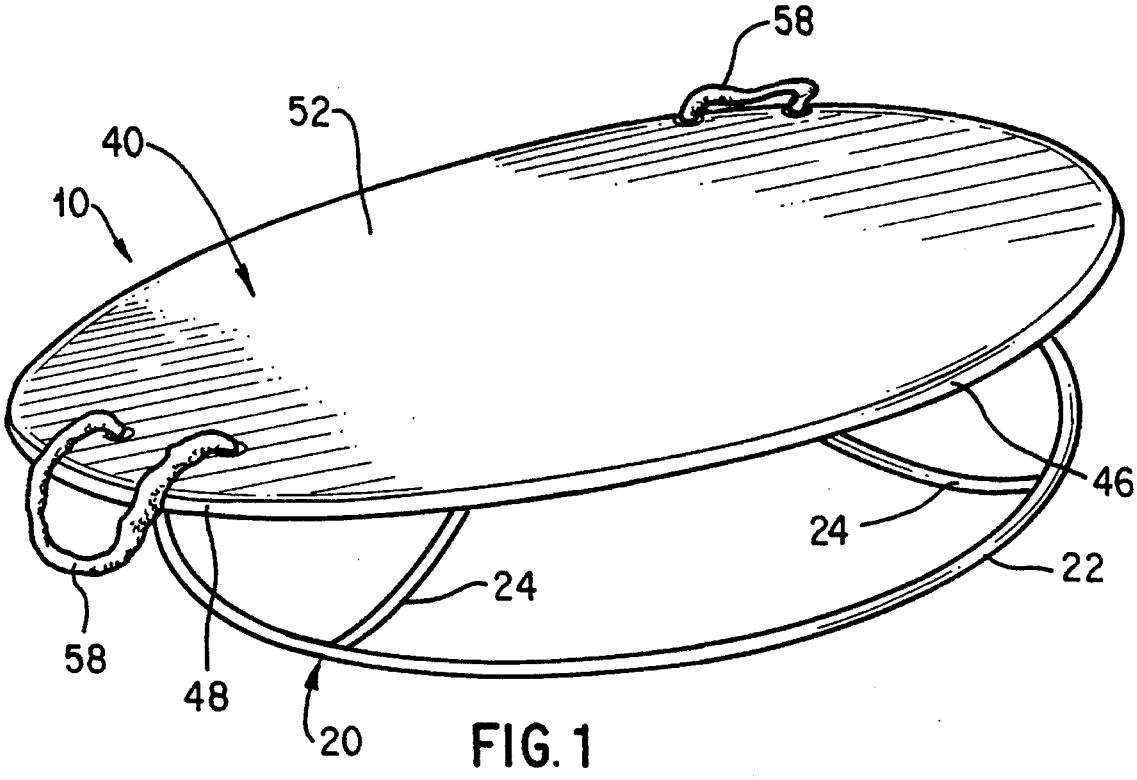
FIG. 1 is a perspective view of the rotating platform apparatus.

The subject matter which I regard as my invention is particularly pointed out and distinctly claimed in the claims. The structure and operation of my invention, together with further objects and advantages, may be better understood from the following description given in connection with the accompanying drawings, in which:

FIG. 1 is a perspective view of the rotating platform apparatus 10, showing the base 20 having an annular ring 22 with legs 24 extending from the annular ring 22 to an inclined collet 30. The annular ring 22 and legs 24 of base 20 are preferably made of metal rod or tubing, and may be secured together by any conventional means. Other materials, such as plastic or fiberglass, may also be used to construct elements of the base 20 without departing from the scope of this disclosure, or the scope of the following claims. The inclined collet 30 has an upper end 32 and a lower end 34, with a collet aperture 28 extending between the upper end 32 and the lower end 34.

Figure 2:
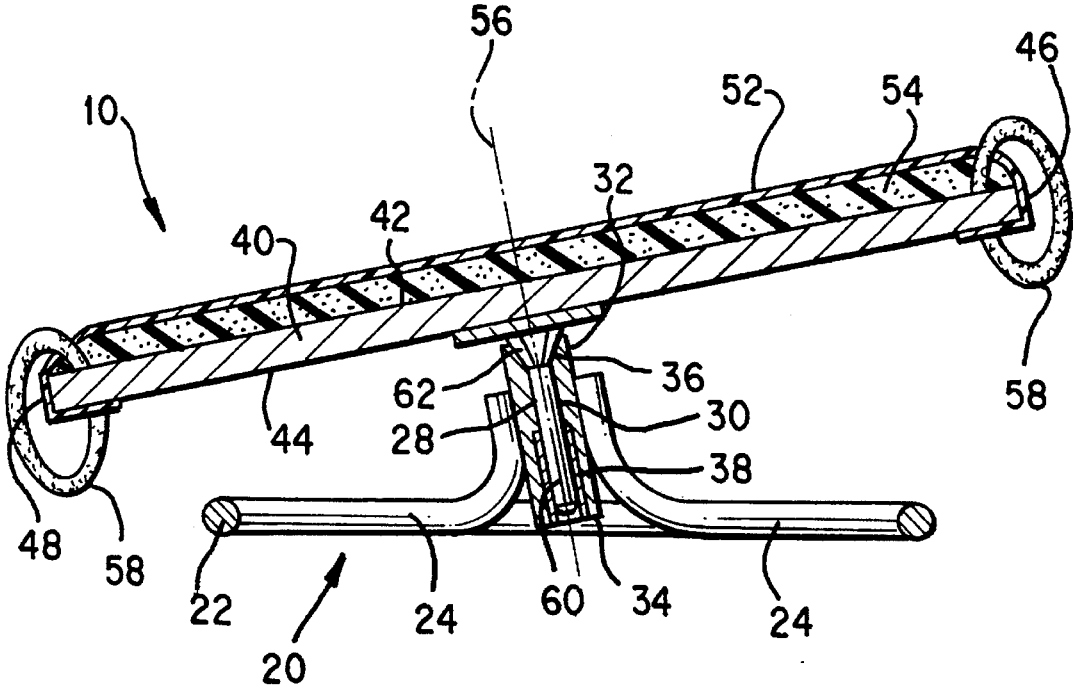
FIG. 2 is a cross-sectional side view of the apparatus showing the base, the inclined collet, and the inclined platform.

As shown in FIG. 2, the inclined collet 30 is preferably inclined at a fixed angle in relation to the annular ring 22, the fixed angle preferably being from fifty-five degrees to eighty-five degrees above the annular ring 22 of the base 20.

A tapered bearing race 36 is located at the upper end 32 of inclined collet 30, in axial alignment with the collet aperture 31. Alternately, a roller bearing (not shown) may be used in place of the tapered bearing race 36, if desired. The tapered bearing race 36 is preferably sized to rotatably receive a tapered bearing 62. The tapered bearing 62 rotatably receives a shaft 60 secured at the axis of rotation to the underside 44 of the inclined platform 40. The shaft 60 extends through the collet aperture 28 within the inclined collet 30. The shaft 60 is rotatably received within a lower bushing 38. The lower bushing 38 is closely received within collet aperture 28 located within the lower end 34 of inclined collet 30.

Alternately, the lower bushing 38 may be in the form of a lower roller bearing (not shown) secured at the lower end 34 of the inclined collet 30, without departing from the scope of this disclosure, or the scope of the following claims.

The inclined platform 40 has a top side 42 and an underside 44 defining a substantially circular configuration 50. A circumferential edge 46 extends about the circular configuration 50 between the top side 42 and the under side 44. The inclined platform 40 is made of conventional materials, such as wood, plastic or metal. The inclined platform 40 is sized to support a user thereon. Preferably, the inclined platform 40 is larger than the base 20.

The top side 42 of inclined platform 40 is preferably covered with a pliable material 52, such as cloth, vinyl or other plastic material, for comfort during use. Padding 54 may be used between the pliable material 32 and the top side 42 of the inclined platform 40, for added comfort. The pliable material 52 preferably extends from the top side 42 over the circumferential edge 48 for securement to the under side 44 of the inclined platform 40. The cover 52 may be secured to the under side 44 of the inclined platform 40 by any conventional means, such as gluing, stapling, screwing, riveting, clamping, etc.

Figure 3:
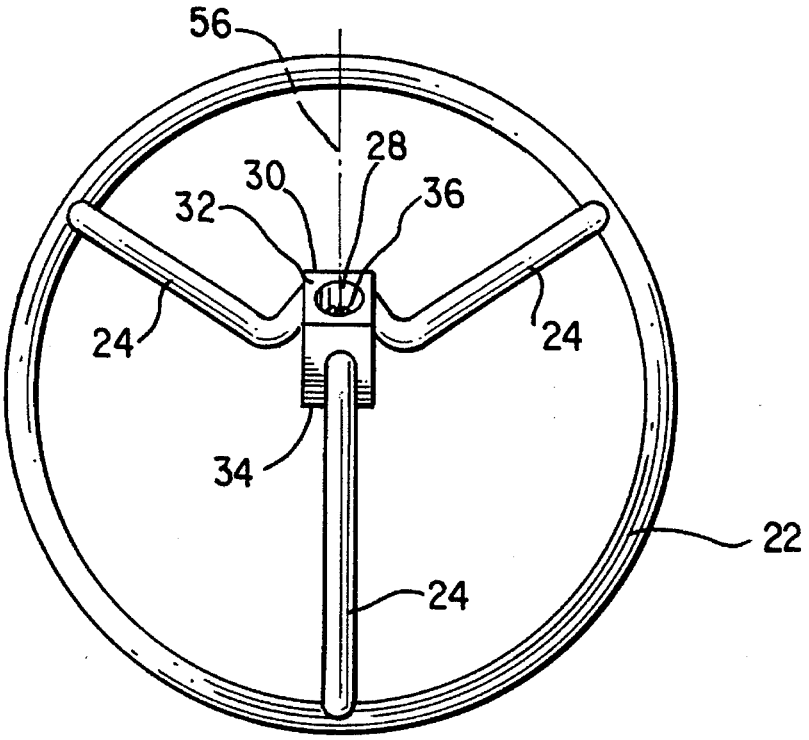
FIG. 3 is a top view of the base and the inclined collet.
Figure 4:
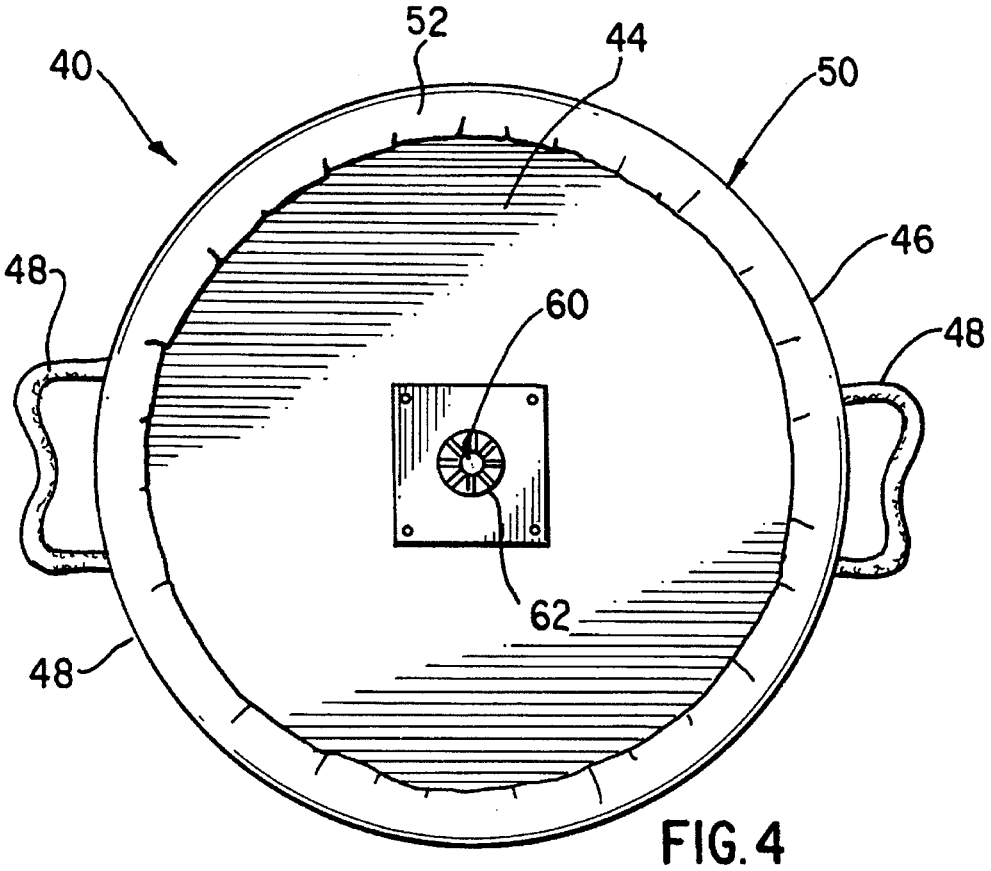
FIG. 4 is a bottom view of the inclined platform.

A perpendicular shaft 60 is rigidly secured at the axis of rotation 56 of the inclined platform 40. A tapered bearing 62 is rotatably received upon the shaft 60. The inclined platform 40 may be removed from the base 20 by lifting the inclined platform 40 sufficiently to remove the shaft 60 from the inclined collet 30, for ease of shipping and storage, as shown in FIG. 3 and FIG. 4. The weight of the user upon the top side 42 of the inclined platform 40 ensures that the shaft 60 extending from the inclined platform 40 into the collet 30 will not come loose during use.

As shown in FIG. 2 through FIG. 4, flexible handles 58, such as rope handles, are secured to the inclined platform 40 at opposite sides in proximity to the circumferential edge 48. Flexible handles 58 reduce the risk of injury should a user fall from the rotating platform apparatus 10 during use.

In operation, the user positions the base 20 of the rotating platform apparatus 10 upon a rug, floor, ground or other substantial surface. The inclined platform 40 shaft 60 is inserted into the collet aperture 28 in preparation for use. The user then positions themselves upon the inclined platform in a sitting, kneeling, standing or supine position (not shown) upon the inclined platform 40. Where appropriate, the user grasps the flexible handles 58, and by shifting body weight or using hand or foot power, begins rotation. Because the shaft 60 is rotatably supported within a tapered bearing 62 located at the top side of the inclined collet 30, and further rotatably supported within the lower bushing 38 located in the collet aperture 28, there is little resistance to rotation of the inclined platform 40.

The center of gravity of the user's weight tends to rotate to the lowest position on the inclined platform 40 when the inclined platform 40 is not being actively rotated. The centrifugal force of rotation provides continuous rotation even with an unbalanced load, providing an exciting spinning ride.

After use of the rotating platform apparatus 10, the inclined platform 40 may be removed from the base 20 for ease of transport and storage. Of course, the rotating platform apparatus 10 may be left in place for later use, or stored as a single unit to suit user preference.

Thus, while the novel rotating platform apparatus has been fully disclosed and described herein, numerous modifications will become readily apparent to one of ordinary skill in this art, and such adaptations and modifications are intended to be included within the scope of the following claims:

What is claimed is:

1. A rotating platform apparatus, comprising:

a) a base formed of an annular ring supporting at least three legs, which are secured at one end to the annular ring, and at the other end to an inclined collet having an inclined collet aperture therethrough, the inclined collet further having an upper end and a lower end, a tapered bearing race is disposed upon the upper end of the inclined collet in concentric alignment with the inclined collet aperture; and b) an inclined platform having a top side and an under side with a circumferential edge located between the top side and the underside, forming a substantially circular configuration of a size suitable to support a user thereon, the under side of the inclined platform having a shaft secured about an axis of rotation, perpendicular to the underside of the inclined platform, the shaft sized to be rotatably received within a tapered bearing upon the upper end of the inclined collet, and extending within the inclined collet aperture to rotatably engage a lower bushing located at the lower end of the inclined collet.

2. The rotating platform apparatus of claim 1, wherein flexible handles are secured upon opposing sides of the inclined platform.

3. The rotating platform apparatus of claim 1, wherein the top side of the rotating platform is covered with a pliable material for comfort.

4. The rotating platform apparatus of claim 3, wherein a padding material is disposed between the pliable material and the top side of the rotating platform for additional comfort.

5. The rotating platform apparatus of claim 1, wherein flexible handles are secured upon opposing sides of the inclined platform.

6. The rotating platform apparatus of claim 1, wherein three legs extend between the annular ring and the inclined collet of the base.

7. The rotating platform apparatus of claim 1, wherein the inclined platform is larger than the base.

8. The rotating platform apparatus of claim 1, wherein the inclined collet is preferably inclined at a fixed angle in relation to the annular ring, said fixed angle being from fifty-five degrees to eighty-five degrees above the annular ring of the base.

9. A rotating platform apparatus, comprising:

a) a base formed of an annular ring supporting at least three legs, which are secured at one end to the annular ring, and at the other end to an inclined collet having an inclined collet aperture therethrough, the inclined collet further having an upper end and a lower end, a tapered bearing race disposed upon the upper end of the inclined collet in concentric alignment with the inclined collet aperture; and b) an inclined platform having a top side and an under side with a circumferential edge located between the top side and the underside, forming a substantially circular configuration of a size suitable to support a user thereon, the under side of the inclined platform having a shaft secured about an axis of rotation, perpendicular to the underside of the inclined platform, the shaft sized to be rotatably received within a tapered bearing sized to be received within the tapered bearing race located upon the upper end of the inclined collet, and extending within the inclined collet aperture to rotatably engage a lower roller bearing located at the lower end of the inclined collet, the top side of the inclined platform sized to be larger than the annular ring of the base.

10. The rotating platform apparatus of claim 9, wherein the inclined platform shaft is removably received within the inclined collet aperture, for ease of transport and storage.

11. The rotating platform apparatus of claim 9, wherein the top side of the rotating platform is covered with a pliable material for comfort.

12. The rotating platform apparatus of claim 11, wherein a padding material is disposed between the pliable material and the top side of the rotating platform for additional comfort.

13. The rotating platform apparatus of claim 9, wherein flexible handles are secured upon opposing sides of the inclined platform.

14. The rotating platform apparatus of claim 9, wherein three legs extend between the annular ring and the inclined collet of the base.

15. The rotating platform apparatus of claim 9, wherein the inclined collet is inclined at a fixed angle in relation to the annular ring, said fixed angle being from fifty-five degrees to eighty-five degrees above the annular ring of the base.

16. A rotating platform apparatus, comprising:

a) a base formed of an annular ring supporting at least three legs, which are secured at one end to the annular ring, and at the other end to an inclined collet having an inclined collet aperture therethrough, the inclined collet further having an upper end and a lower end, a roller bearing race is disposed upon the upper end of the inclined collet in concentric alignment with the inclined collet aperture, the inclined collet is inclined at a fixed angle being from fifty-five degrees to eighty-five degrees above the annular ring of the base;

b) an inclined platform having a top side and an under side with a circumferential edge located between the top side and the underside, forming a substantially circular configuration of a size suitable to support a user thereon, the under side of the inclined platform having a shaft secured about an axis of rotation perpendicular to the underside of the inclined platform, the shaft sized to be rotatably received within a roller bearing disposed upon the upper end of the inclined collet, the shaft extending within the inclined collet aperture to rotatably engage a lower roller bearing located at the lower end of the inclined collet; and c) flexible handles secured upon opposing sides of the inclined platform.

17. The rotating platform apparatus of claim 16, wherein the inclined platform shaft is removably received within the inclined collet aperture, for ease of transport and storage.

18. The rotating platform apparatus of claim 16, wherein the top side of the rotating platform is covered with a pliable material for comfort.

19. The rotating platform apparatus of claim 16, wherein a padding material is disposed between the pliable material and the top side of the rotating platform for additional comfort.

20. The rotating platform apparatus of claim 16, wherein three legs extend between the annular ring and the inclined collet of the base.

* * * * *